United States Patent [19]

Dickhart, III

[11] 4,271,765

[45] Jun. 9, 1981

[54] RAILWAY CAR TILTING STABILIZING SYSTEM

[75] Inventor: William W. Dickhart, III, Fort Washington, Pa.

[73] Assignee: The Budd Company, Troy, Mich.

[21] Appl. No.: 50,830

[22] Filed: Jun. 21, 1979

[51] Int. Cl.[3] ..... B61F 3/08; B61F 5/24; B61F 5/50

[52] U.S. Cl. ..... 105/164; 105/182 R; 105/199 R; 105/199 A; 105/210

[58] Field of Search ..... 105/164, 182 R, 199 A, 105/199 R, 210

[56] References Cited

U.S. PATENT DOCUMENTS

| | | | |
|---|---|---|---|
| 2,863,400 | 12/1958 | Runken | 105/199 R X |
| 3,486,466 | 12/1969 | Rodgers | 105/199 R |
| 3,720,175 | 3/1973 | Russell-French | 105/199 R |
| 3,810,429 | 5/1974 | Kallenbach | 105/164 X |
| 3,941,061 | 5/1976 | Schindehütte et al. | 105/182 X |

*Primary Examiner*—John P. Silverstrim
*Assistant Examiner*—Howard Beltran
*Attorney, Agent, or Firm*—A. L. Trueax, Jr.

[57] ABSTRACT

A tilt control system comprises a roll bar structure having two separate opposite rotatable members attached on the bottom of both sides of the car body between the car body and bolster. A pair of lever arms connect the ends of the rotatable members to the bolster. Means are provided for selectively rotating the rotatable members to actuate the lever arms in opposite directions to force the car body to tilt laterally with respect to the bolster.

10 Claims, 10 Drawing Figures

FIG. 8
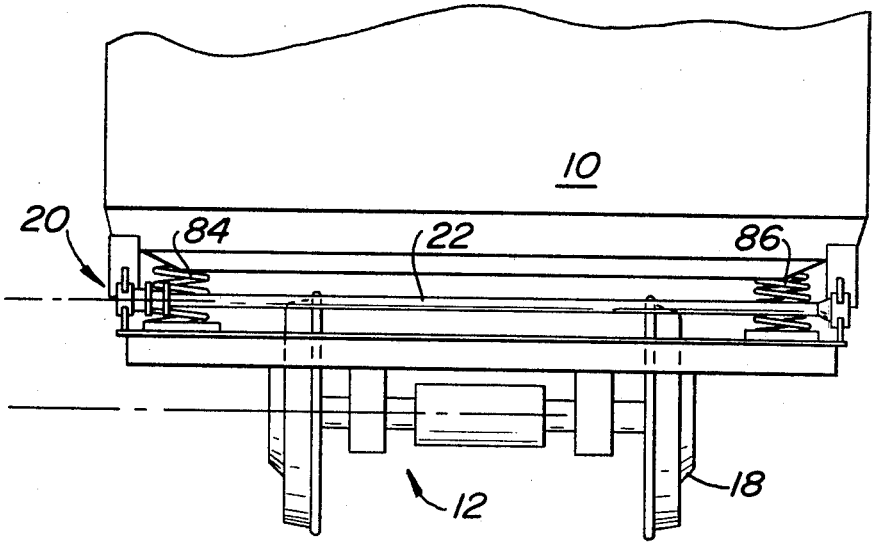
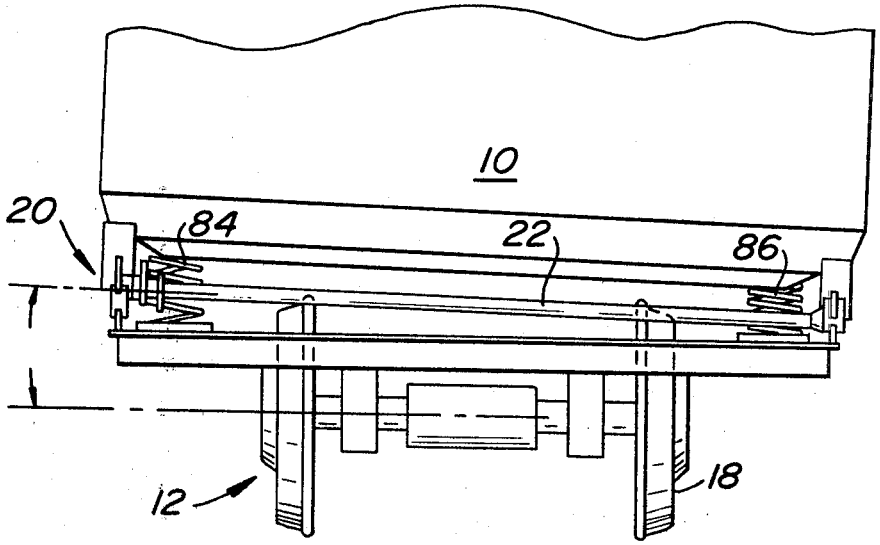
FIG. 9

RAILWAY CAR TILTING STABILIZING SYSTEM

A number of systems have been used for tilting railway cars to provide passenger comfort when the cars move around curves at relatively high speeds. Such systems have included swing hangers, inclined links, rollers on curved ways and scissors links.

Some tilt systems used heretofore involve mechanisms that are located below the secondary springs. This arrangement allows the car body to tilt in a reverse direction thereby requiring more tilt of the system to achieve the desired amount of tilt of the car body. In these systems, the centrifugal forces created by turning tend to overcome the desired tilting. In general, the aforementioned systems must be parts of the original designs of the car and its associated bolster. This makes it difficult to retrofit existing railway cars without extensive overhaul.

Some existing systems utilize roll bars. Such roll bars connected to the bottom sides of the car body between the car body and the bolster. The roll bars are designed to prevent excessive roll or one side of the car body from tilting with respect to the other side of the car body.

It is an object of this invention to provide an improved tilt system for selectively tilting a car body.

It is a further object of this invention to provide an improved system which combines the advantages of both a roll bar and selective tilting in a railway car.

It is still a further object of this invention to provide a system for preventing undesired roll during a controllable tilting operation.

It is still a further object of this invention to provide an improved system to produce a programmable amount of tilt in a car body.

In accordance with the present invention a tilt system for a railway car body supported on a truck is provided. A roll bar structure comprising two rotatable members are attached to the car body on the bottom of both sides between the car body and the bolster. A pair of lever arms connect the ends of the two rotatable members to link elements on the bolster. Means for selectively rotating the rotatable members in opposite directions are provided. Rotation of the rotatable members move the lever arms and links to force made the car body to tilt laterally with respect to the bolster, with the angle of tilt being programmable or controllable.

Other objects and advantages of the present invention will be apparent and suggest themselves to those skilled in the art from a reading of the following specification and claims, taken in conjunction with the accompanying drawings, in which:

FIG. 8 is an end view of a railway car embodying the present invention in an untilted position, and FIG. 9 is an end view of a railway car embodying the present invention in a tilted position.

Figure 1:
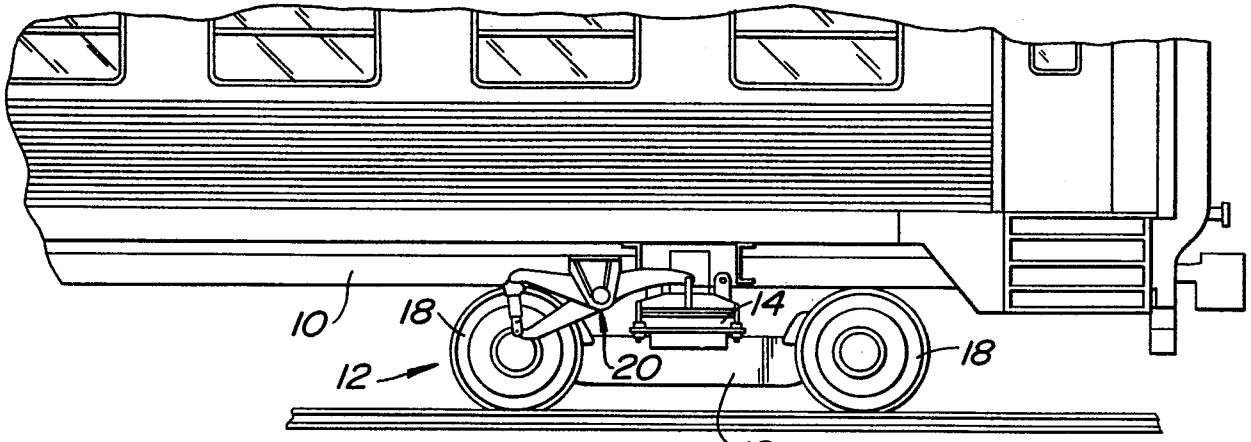
FIG. 1 is a side view, partly broken away, for a railway car supported by a truck in which the present invention is incorporated.
Figure 4:
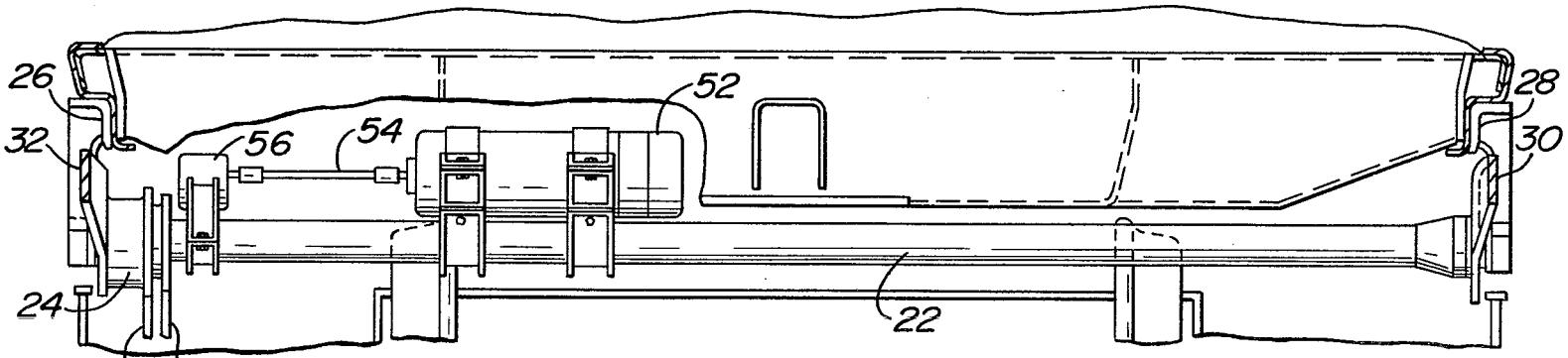
FIG. 4 is a view, partly in cross-section, taken along lines 4—4 of FIG. 2.

Referring to FIG. 1, a conventional railway car 10 includes a truck assembly 12 located thereunder. The truck assembly includes conventional items such as a bolster 14, side frames 16 and wheels 18. As will be described in detail in subsequent figures, a tilting mechanism 20 is suitably connected between the bottom sides of the car body 10 and the bolster 14.

Referring to FIGS. 2 to 7, along with FIG. 1, a pair of rotatable members 22 and 24 are secured to rotate in brackets 26 and 28 which are fixably mounted to the car body 10. The ends of the rotatable members 22 and 24 are free to rotate within the brackets 26 and 28. The arrangement of the rotatable members 22 and 24 when not rotating, is similar to a roll bar which is found in some prior art systems. Basically, the rotatable members 22 and 24 may be considered as a single unit or roll bar during operating conditions of the car in which no tilting is applied or desired. The difference between the rotatable members 22 and 24 and a conventional roll bar is that the ends of the members 22 and 24 are free to rotate to provide a tilting action of the car 10 with respect to the truck 12, as will be described.

The rotatable members 22 and 24 may be equal in length, if desired, which would mean that the controls for the tilt system would be toward the center of the car. However, in the preferred embodiment, as illustrated, one of the pieces for member 24 is made much shorter than the member 22 so that the working mechanism relating to the tilting arrangement is readily available at the side of the car.

Figure 2:
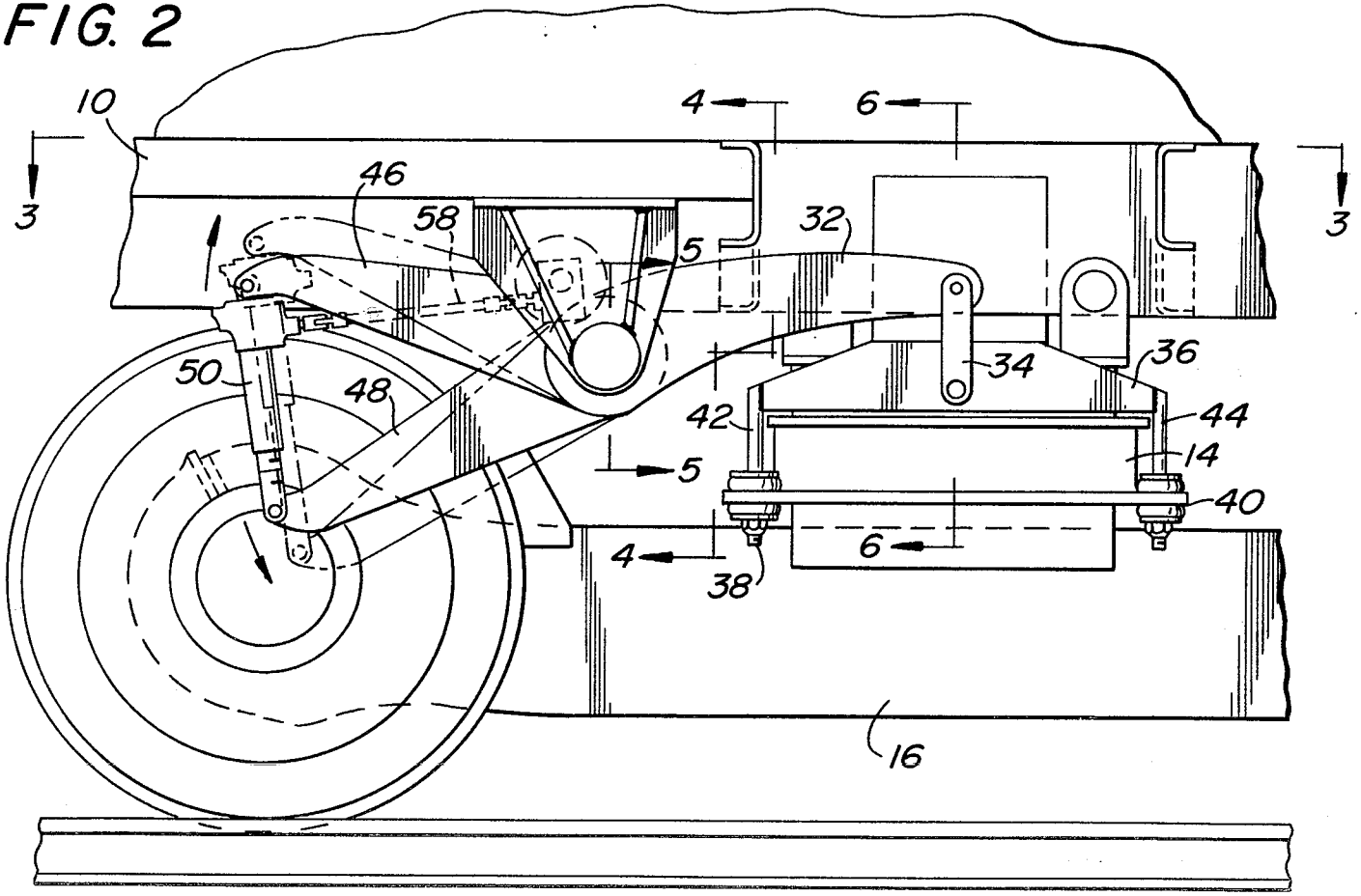
FIG. 2 is an enlarged side view of the mechanism for tilting the car body, in accordance with the present invention.
Figure 7A:
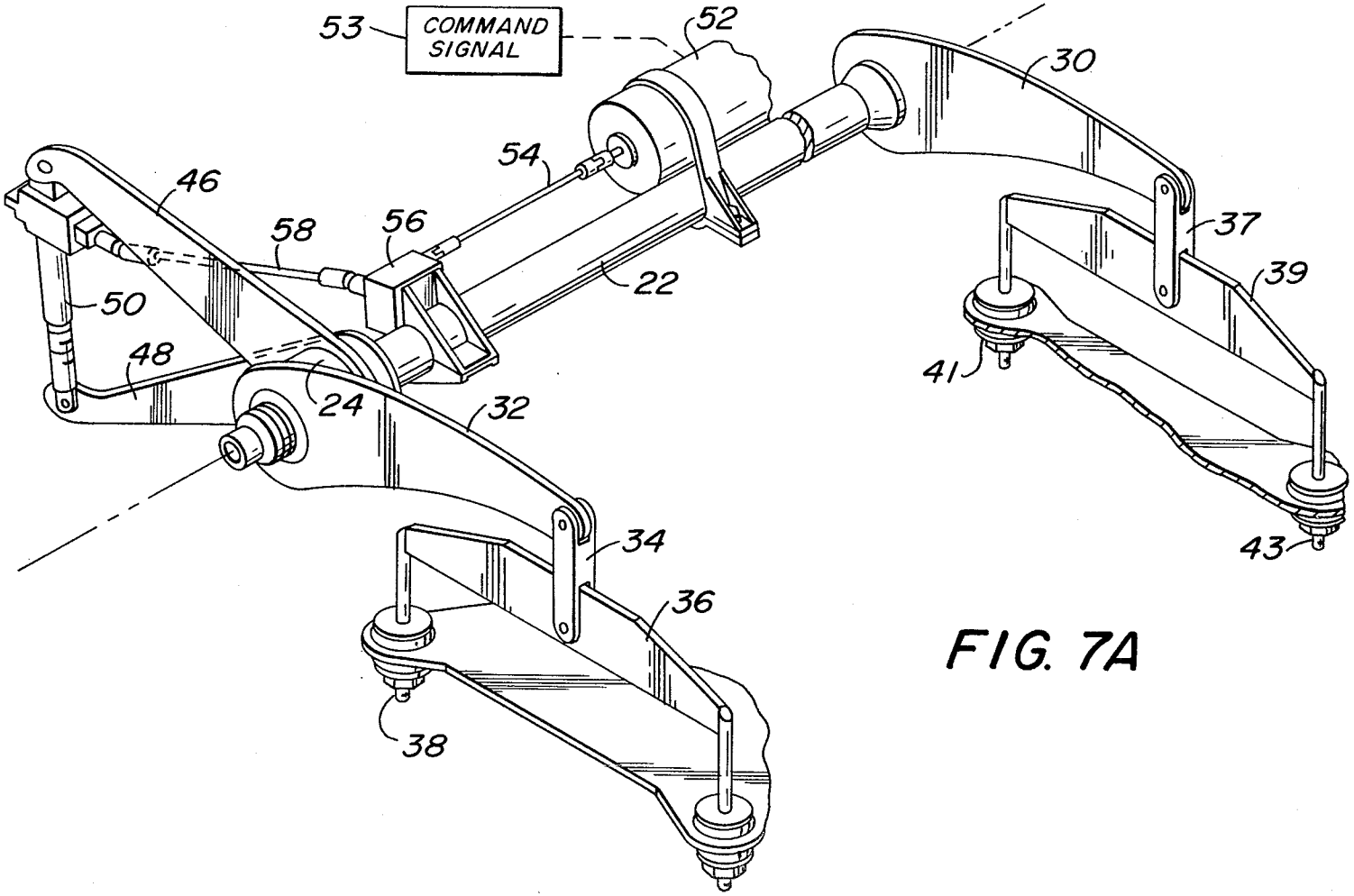
FIG. 7A is an isometric view of the tilt system embodying the present invention in an unactuated position.

The ends of the members 22 and 24 are connected to lever arms 30 and 32, respectively. The lever arms 30 and 32 are adapted to move or be pivoted about the ends of the rotatable members 22 and 24 during a tilting operation. The other ends of the lever arms 30 and 32 are connected to a pair of links 34 and 37 (FIG. 7A), with the link 34 being illustrated in FIG. 2. The links 34 and 37 are pivotally connected between the lever arms 30 and 32 and steel plates 36 and 39 (FIG. 7A). The steel plates, 36 and 39 are fixedly secured to the bolster 14 by means of suitable mounting means. As seen in FIG. 2 screws 38 and 40 threadedly engage thread members 42 and 44. The plate 39 is likewise secured to the bolster by suitable mounting means (FIG. 7A). Because the steel plate 36 is fixed to the bolster 14, the link 34 may in effect be considered as being connected directly to the bolster 14. This is also true of the link 37. Consequently, when the lever arms 30 and 32 are rotated, one end of the lever arm will tend to stay fixed with respect to the car 10 and the other end will tend to move up or down, depending upon the tilting direction, to transmit force through the links 34 and 37 to force the car body 10 up or down with respect to the bolster 14. The present invention is designed to move the lever arms 30 and 32 in opposite directions so that the associated links 34 and 37 will tend to permit the sides of the car 10 to be tilted up or down in opposite directions.

Figure 5:
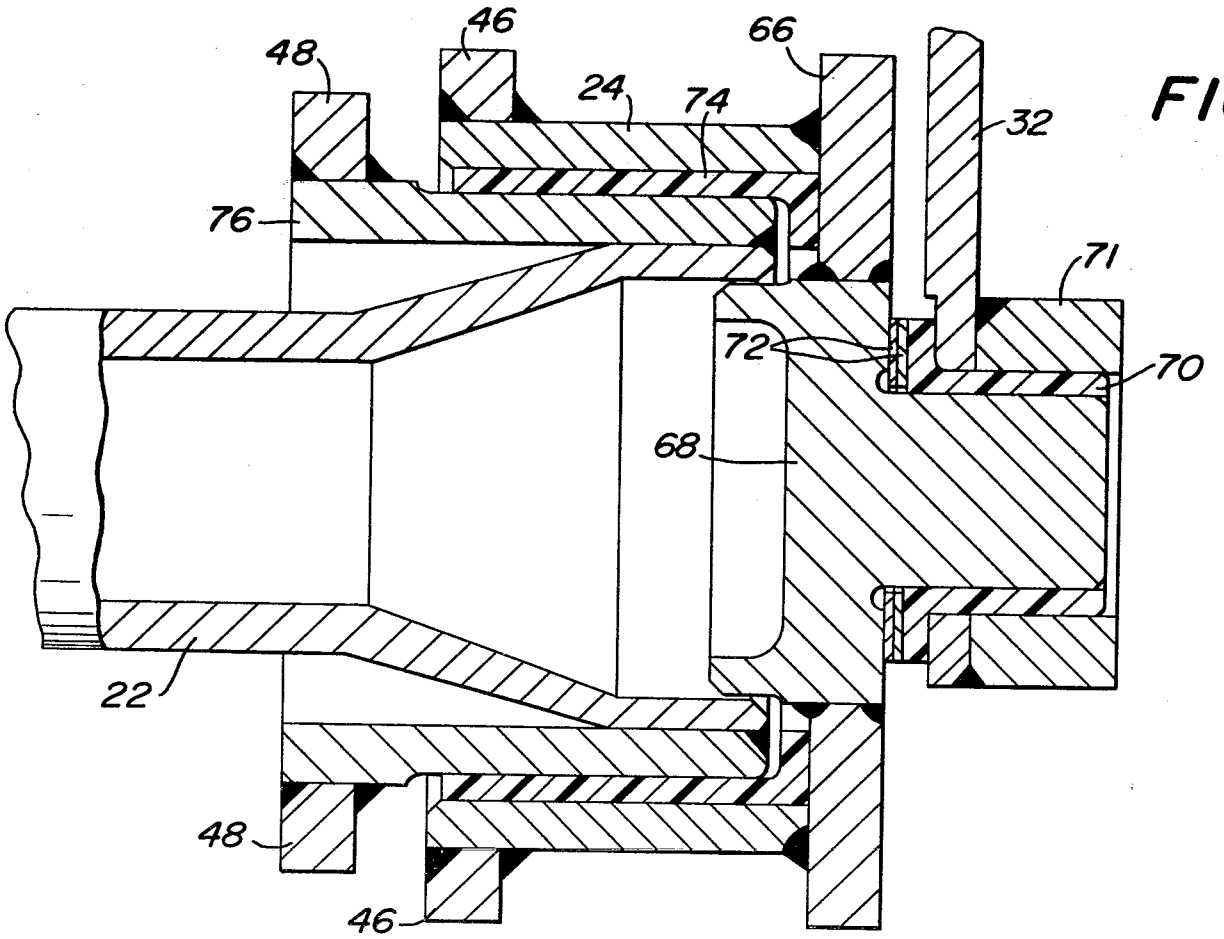
FIG. 5 is a cross-sectional view taken along lines 5—5 of FIG. 2.
Figure 7B:
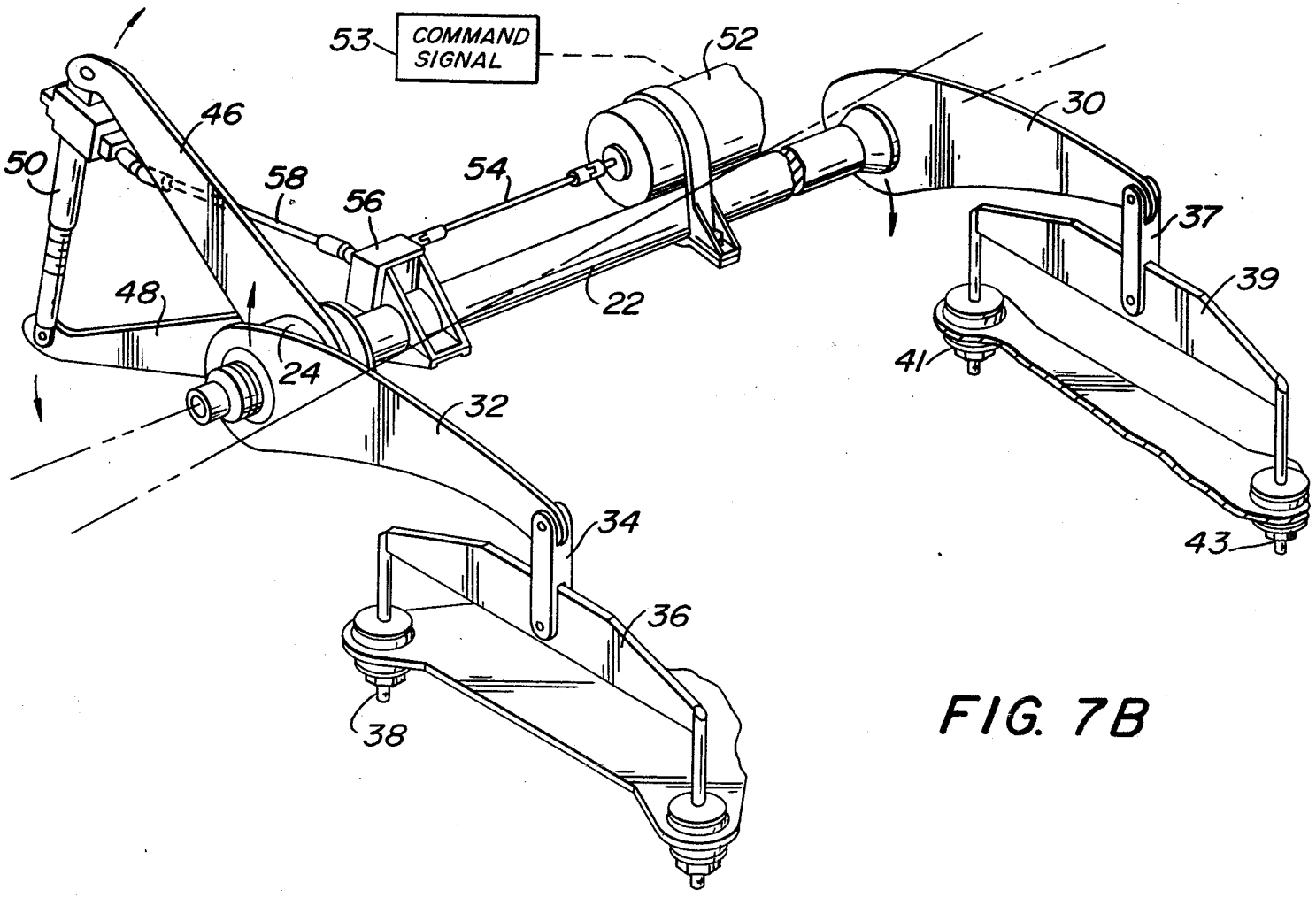
FIG. 7B is an isometric view of the tilt system embodying the present invention in an actuated position.

A pair of arms 46 and 48 are fixedly secured to the members 24 and 22, respectively, with the detailed connections being illustrated in FIG. 5. The rotatable member 22 is connected to be rotated by the arm 48 and the rotatable member 24 is connected to be rotated by the arm 46. The arms 46 and 48 are mounted in suitable bearings and are adapted to be pivotally rotated about the axis of the members 22 and 24. A ball bearing screw actuator, or other suitable means, 50 is connected between the free ends of the arms 46 and 48. Various hydraulic, pneumatic or mechanical devices capable of expansion and contraction may be employed in place of the ball screw actuation. The ballbearing screw actuator 50 is adapted to expand or contract in accordance with a signal applied thereto. In FIG. 2, the solid lines of the arms 46 and 48 represent the positions of the arms with no tilting being applied. The dotted lines of the arms 46 and 48 represent a condition where the ball screw actuator 50 is expanded as during a tilting operation. FIGS. 7A and 7B also illustrated these two conditions.

A unit 52 is suitably mounted to the rotatable member 22 by any suitable means. The unit may include a positioning sensor, a motor brake, a D.C. servo motor and a gear box. The output from the gear box is applied to an arm 54. The arm 54 is adapted to be rotated in accordance with a command signal from a source 53 indicating that a tilting operation is to take place. The tilting signal from the source 53 to operate the unit may be generated by various means. For example signals may emanate from the locomotive movement indicating that a turn is taking place. Accelerometers suitably located in the car may also be used. The signals to operate the tilting mechanism may be generated manually or automatically. Such means for sensing turns in angular directions are well known and therefore not described in detail since they are incidental to the present invention.

The mechanical output of the arm 54 is connected to a gear box 56, which transmits the energy from the arms 54 to rotate a second arm 58. Suitable joints are provided at the connecting points between the arms 54 and 58 and the gear box 56. The arm 58 is adapted to be rotated in accordance with a tilting movement to actuate the ballbearing actuator screw 50. For example, if the arm 58 moves in a counter-clockwise direction, it may expand the ball screw actuator 50. In like manner if the arm 58 rotates in the opposite direction, it contracts the ball screw actuator 50. Expansion or contraction of the ball screw actuator 50 increases or decreases the distance between the arms 46 and 48. Such ball screw actuators are well known to those skilled in the art and is therefore not described in detail.

When the arms 46 and 48 are moved a greater distance apart, indicating that a tilting of the car is taking place, the rotatable member 24 is moved in a clockwise direction. At the same time, the arm 48 causes the rotatable member 22 to move in a counter-clockwise position. These directions are with respect to the view taken in connection with FIG. 2, FIG. 7A and FIG. 7B. When the arm 46 moves down to force the member 24 to move counter-clockwise, the lever arm 32 fixed to the link 34 forces the side of the car to move down. The reason for this is that the end of the member 24 will move the bracket 26 down. At the same time, the arm 48, moving counterclockwise, causes the member 22 to rotate and the side of the body including the bracket 82 to be forced upwardly.

When the signal applied from the source 53 to the position sensor in the unit 52 is opposite to that described, an opposite operation will take place. In this case, the ball screw actuator 50 will contract to cause the arms 46 and 48 to move closer together. The arm 48 causes the end of the rotatable member 24 to rotate clockwise. The arm 46 causes the rotatable member 22 to rotate counter-clockwise. In this case, the side of the car with the bracket 26 will move down and the side of the car with the bracket 28 will move up.

FIG. 8 illustrates an end view of the car when no tilting operation is applied. FIG. 9 illustrates an end view of the car in which a tilting operation is applied with the left side of the car moving up and the right side of the car moving down. It is understood that the opposite tilting operation could also take place. In this case the right side of the car will tilt up and the left side of the car will tilt down as illustrated in FIG. 9. In FIGS. 8 and 9, coil springs 84 and 86 are illustrated. Air springs are illustrated in the embodiment in the other figures. The invention will work with either type spring arrangement, with the air springs providing easier tilting as a result of the air transferring back and forth between the springs during tilting operations.

Figure 3:
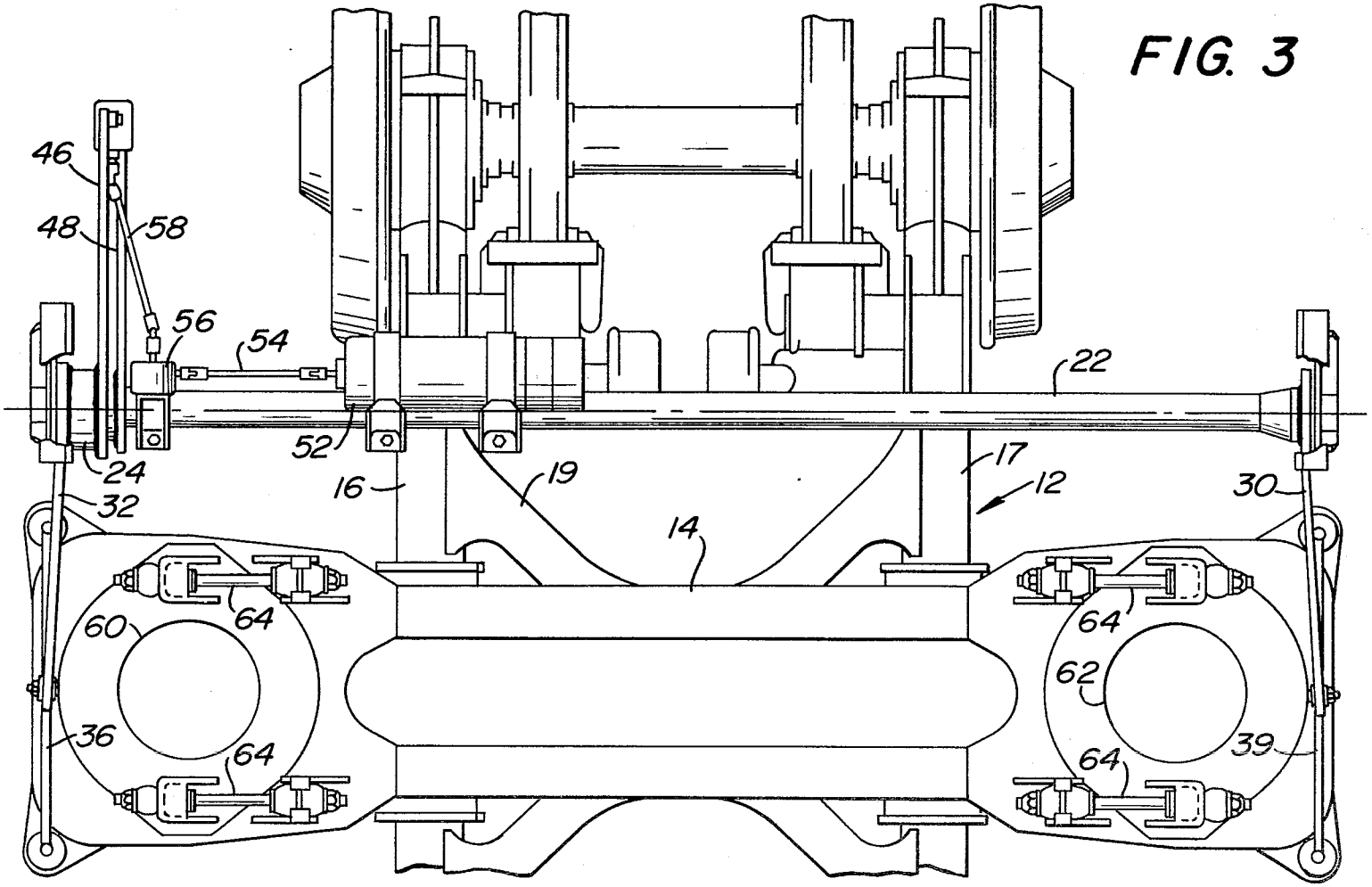
FIG. 3 is a view taken along lines 3—3 of FIG. 2.

FIG. 3 illustrates various other features relating to the truck which is not directly related to the invention. As illustrated, the truck 12 includes the side frames 16 and 17 connected by a suitable spider arrangement 19. The bolster 14 is secured to the side frames 16 and 17. The ends of the bolster are designed to carry suitable air springs 60 and 62. Various shock absorbers 64 may also be employed. Such features relating to the truck are well known and therefore not described in detail.

Referring to FIG. 5, the rotatable members 22 and 24 are illustrated with their various bearing elements and also illustrates the connections between the parts. The arm 46 is suitably welded to the rotatable element 24. The rotatable element 24 is connected by welding or otherwise to a connecting member 66. The connecting member 66 is secured to a second connecting member 68 which is rotatably mounted in a low friction bearing 70 mounted in a bearing 71. Washers 72 are provided between the member 68 and the bearing 70. A bearing 74 is disposed between the rotatable member 24 and an inner connecting member 76.

When the arm 46 is actuated, the rotatable member 24 is also rotated to cause the lever 32 to move up or down to provide a tilting movement of the car. It is seen that the arm 46 and rotatable member 24 and associated lever 32 is independent of the operation of the motion of the arm 48 which is utilized to rotate the other rotatable member 22.

Arm 48 is welded to the member 76 which in turn is welded to the end of the rotatable member 22. Movement of the arm 48 will cause the rotatable member 22 to rotate, which in turn will cause a lever 30 to be moved up or down. As mentioned, the arms 46 and 48 will move in opposite directions so that the directions of rotation of the members 22 and 24 are opposite. This causes the levers 30 and 32 on either side of the car to also move in opposite directions. Consequently, when a tilting operation is applied, one side of the car will tend to move down while the other side will tend to move up, and vice-versa.

It is noted that when no tilting operation is applied, the relative position of the arms 46 and 48 will remain constant. The rotatable members 22 and 24 will therefore not rotate with respect to each other and act as a unit. Consequently, no tilting action will take place. At the same time, the connections between the members 22 and 24 are such that they may be considered fixed with respect to each other. This means that the members 22 and 24 may operate as a conventional roll bar. Thus the arrangement illustrated is capable of providing the advantages of a roll bar to prevent tilt and at the same time provide a tilting operation upon command.

Figure 6:
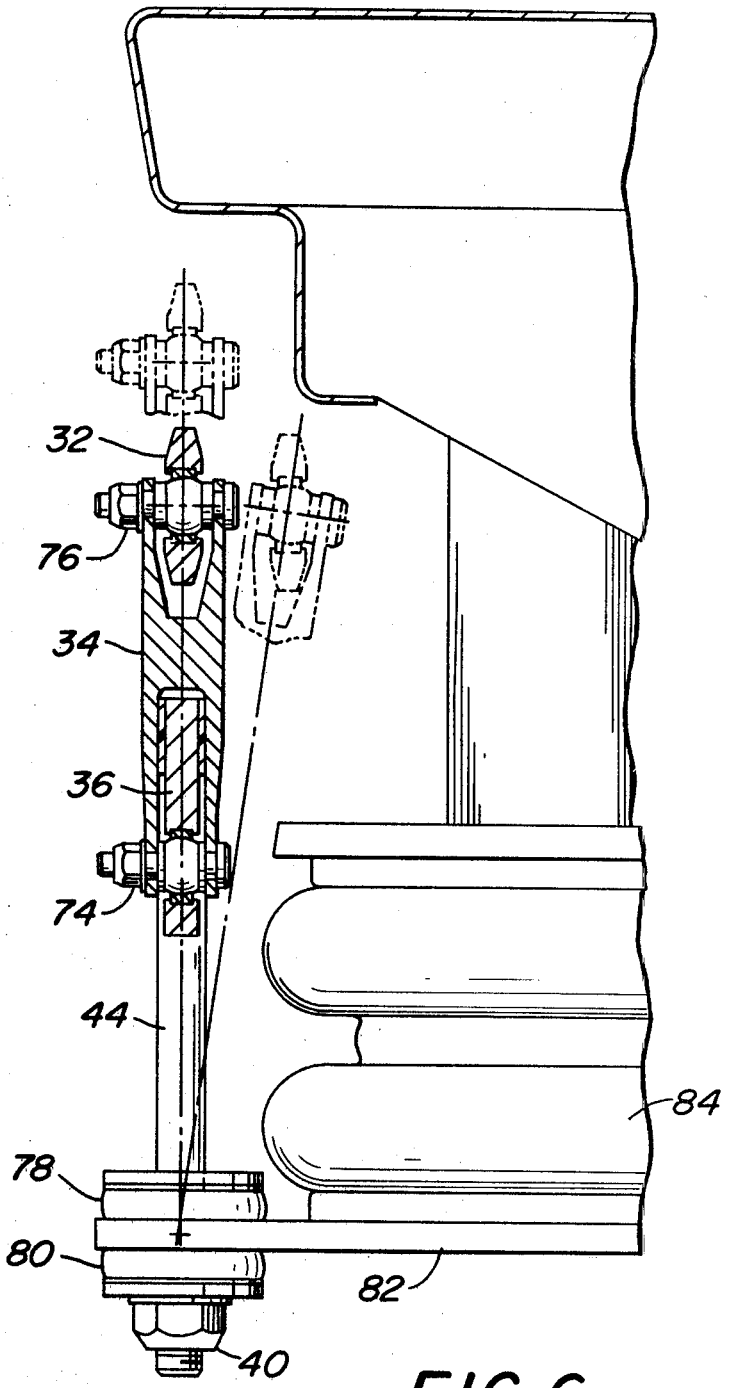
FIG. 6 is a view, partly in cross-section, taken along lines 6—6 of FIG. 2.

Referring particularly to FIG. 6, details of the various mechanical parts associated with one of the links 34 is illustrated. The link 34 is connected to the steel plate 36 by means of a suitable bolting arrangement 74. The free end of the link 34 is connected to the lever arm 32 to a suitable bolting arrangement 76. The up and down motion as well as the side motion of the link is a result of a tilting action and also the result of some lateral movement of the car body with respect to the bolster as a result of movement of the air springs carrying the car. Flexible members 78 and 80 are connected to a plate 82, which in turn is connected to the bolster and supports the air spring 84. The bearings 78 and 80 permit the lateral movement of the link 34.

FIGS. 7A and 7B are isometric views illustrating the main moving parts involved in the tilting operation of the present invention. FIG. 7A illustrates the various elements when the car 10 is in an untilted position. FIG. 7B illustrates a condition in which the car is to be tilted in one direction, it being understood that the car may be tilted in the other direction also.

Referring to FIG. 7B, along with FIG. 7A, assume it is desired to tilt the left side of the car up and the right side down. In this case, the ball screw actuator 50 will expand to expand the arms 46 and 48. When the lever arm 46 is moved up, as indicated by the arrow, the left side of the car will move up. As the arm 46 moves up, the arm 48 moves down to cause the member 22 to rotate in a direction to force the link 37 in a downward direction. The arrangement of the mechanical elements on the right side of the car includes a link 37, a steel plate 39, mounting means 41 and 43 all of which are designed to operate the same as the opposite elements on the left side of the car.

If the ball screw actuator 50 contracts, the arms 46 and 48 will move closer together. The rotatable members 22 and 24 will therefore operate in opposite directions to that previously described. This causes the left side of the car to go down and the right side of the car to be tilted up.

What is claimed is:

1. In combination with a railway car body and a supporting truck having a bolster connected to a pair of side frames of said truck, a tilt control system comprising:

(a) a bar structure comprising a first and a second rotatable member rotatably attached to said car body on both sides between said car body and said bolster, (b) a pair of lever arms rigidly connected to said two rotatable members and operably connected to said bolster, and (c) a pair of driving arms having one end of one driving arm secured to said first rotatable member and one end of the other driving arm secured to said second rotatable member and the other end of each driving arm being in spaced relationship to each other and operably connected to a reversible driving means for movement toward and away from each other upon actuation of said driving means whereby tilt control is accomplished by selectively rotating said rotatable members in opposite directions and toward each other to move said lever arms to force said car body to tilt with respect to said truck.

2. A combination as set forth in claim 1 wherein a bolster is connected to a pair of side frames of said truck with one end of said lever arms being mounted to said bolster and the other end of said lever arms being fixed to the respective ends of said rotatable members.

3. A combination as set forth in claim 2 wherein a pair of driving arms having one end fixed to said rotatable members and the free ends being disposed in spaced relationship with respect to each other, and wherein driving means are provided disposed between said free ends to expand and contract said driving arms to rotate said rotatable members and said lever arms.

4. The combination as set forth in claim 3 wherein a pair of fixed brackets are connected to said car body to receive the ends of said rotatable members to permit said rotatable members to rotate therein.

5. The combination as set forth in claim 4 wherein a pair of links are connected between said lever arms and said bolster.

6. The combination as set forth in claim 5 wherein a pair of plates are resiliently mounted to said bolster to receive said pair of links.

7. The combination as set forth in claim 6 wherein said driving means comprises a ball screw actuator.

8. The combination as set forth in claim 7 wherein a source of command signals is provided to selectively actuate said ball screw actuator.

9. The combination as set forth in claim 8 wherein said driving means further includes a sensor for receiving said command signals to rotate a pair of arms connected through a gear box to drive said ball screw actuator.

10. The combination as set forth in claim 9 wherein said tilt control system is disposed towards one side of said car body between said car body and said bolster.

* * * * *